United States Patent [19]

Aramaki

[11] 3,948,072

[45] Apr. 6, 1976

[54] PRESTRESSED UNIVERSAL ROLLING MILL

[75] Inventor: Keiichi Aramaki, Fukuyama, Japan

[73] Assignee: Nippon Kokan Kabushiki Kaisha, Tokyo, Japan

[22] Filed: Jan. 29, 1975

[21] Appl. No.: 545,279

[30] Foreign Application Priority Data

Feb. 18, 1974 Japan ..... 49-18508

[52] U.S. Cl. ..... 72/225; 72/245; 72/248

[51] Int. Cl.[2] ..... B21B 31/04; B21B 13/08

[58] Field of Search ..... 72/225, 237, 245, 248

[56] References Cited

UNITED STATES PATENTS

| | | | |
|---|---|---|---|
| 3,098,404 | 7/1963 | Morath et al. | 72/225 |
| 3,124,982 | 3/1964 | Neumann | 72/21 |
| 3,587,278 | 6/1971 | Kracht | 72/237 |
| 3,802,242 | 4/1974 | Svagr | 72/225 |

*Primary Examiner*—Milton S. Mehr
*Attorney, Agent, or Firm*—Ladas, Parry, Von Gehr, Goldsmith & Deschamps

[57] ABSTRACT

There is provided a prestressed universal rolling mill of a type in which a housing is divided into three parts, i.e., an upper cross beam carrying a top horizontal roll, an intermediate frame carrying vertical rolls and a lower cross beam carrying a bottom horizontal roll, and these three parts are clamped together by means of tension bars, whereby after the clamping force on the housing has been released, the tension bars are rotated to simultaneously move the upper and lower cross beams the same distance in different directions, thereby making it possible to readily adjust the position of the top and bottom horizontal rolls and making the construction of the roll stand itself compact and rigid.

5 Claims, 3 Drawing Figures

PRESTRESSED UNIVERSAL ROLLING MILL

BACKGROUND OF THE INVENTION

The present invention relates to prestressed universal rolling mills adapted for rolling H-section and other shape steels of various sizes.

Rolling mills of this type must meet such requirements as simple and lightweight construction, low cost, reduced roll changing time and high mill rigidity, and a variety of rolling mills of this type have been proposed. For instance, with a known rolling mill of this type in which an upper cross beam carrying a top horizontal roll and a lower cross beam carrying a bottom horizontal roll are respectively arranged above and below an intermediate frame securely held on a sole plate and equipped with vertical rolls, and the upper and lower cross beams are held together by means of four tie rods, the mill stiffness relating to the horizontal rolls is largely dependent on the elongation of the tie rods so that if the rod diameter is 220 mm, the rod length is 2,600 mm, the roll diameter is 1,200 mm, the size of an H-section to be rolled is 500 mm × 200 mm × 10 mm × 16 mm and the maximum rolling reaction force is 1,200 tons, then the resulting elongation is 0.98 mm or 0.08 mm per 100 tons. In the case of an conventional rolling mill, the corresponding elongation is about 0.02 mm per 100 tons, and this is far smaller than that of the rods in the above-mentioned universal rolling mill. In other words, while the mill rigidity of the above-mentioned universal rolling mills is low and this low mill rigidity may be improved by increasing the diameter of the tie rods, it is difficult to do so in consideration of the structure of this type of rolling mills. In addition, since there are instances where the maximum rolling force or load during a rolling operation amounts to 1,200 tons and the resulting elongation of the tie rods also amounts to 0.98 mm as mentioned previously, a clearance is produced between the intermediate frame and each of the upper and lower cross beams with the result that the position of the rolls carried on these beams and frame tend to be easily shifted, and hence the dimensional accuracy of products is adversely affected. Still further, while it is generally necessary to provide a breaker to prevent the occurrence of any serious accident due to a jamming or the like that will be caused by erroneous settings of the roll clearance or the like, the provision of such a breaker block also tends to result in a deteriorated mill stiffness.

SUMMARY OF THE INVENTION

With a view to overcoming the foregoing difficulty, it is an object of the present invention to provide a prestressed universal rolling mill in which upper and lower cross beams and an intermediate frame are bound together by means of tension bars consisting of prestressed tie rods to ensure an improved mill rigidity.

It is another object of the present invention to provide a prestressed universal rolling mill provided with tension bars and associated component structures which are designed so that whenever the grade and/or size of material to be rolled are changed as is frequently the case with rolling mills of this type, the compression force applied to a housing is released as a result of a force applied by hydraulic pressure to tension bars for the purpose of elongating them and then the tension bars are rotated to change the clearance of horizontal rolls thereby easily and quickly providing the required prestressing that suits the changed settings.

It is still another object of the present invention to provide such a prestressed universal rolling mill having means whereby when an abnormal accident such as jamming of a material being rolled is caused by any erroneous settings of the roll clearance or the like, a hydraulic pressure is applied to the tension bars to readily release the jammed material.

It is still another object of the present invention to provide such a prestressed universal rolling mill having a simple mill construction and designed to eliminate the use of a breaker block constituting one of the causes which tend to reduce the mill rigidity.

DESCRIPTION OF THE PREFERRED EMBODIMENT

The present invention will now be described in greater detail with reference to the illustrated embodiment.

Figure 1:
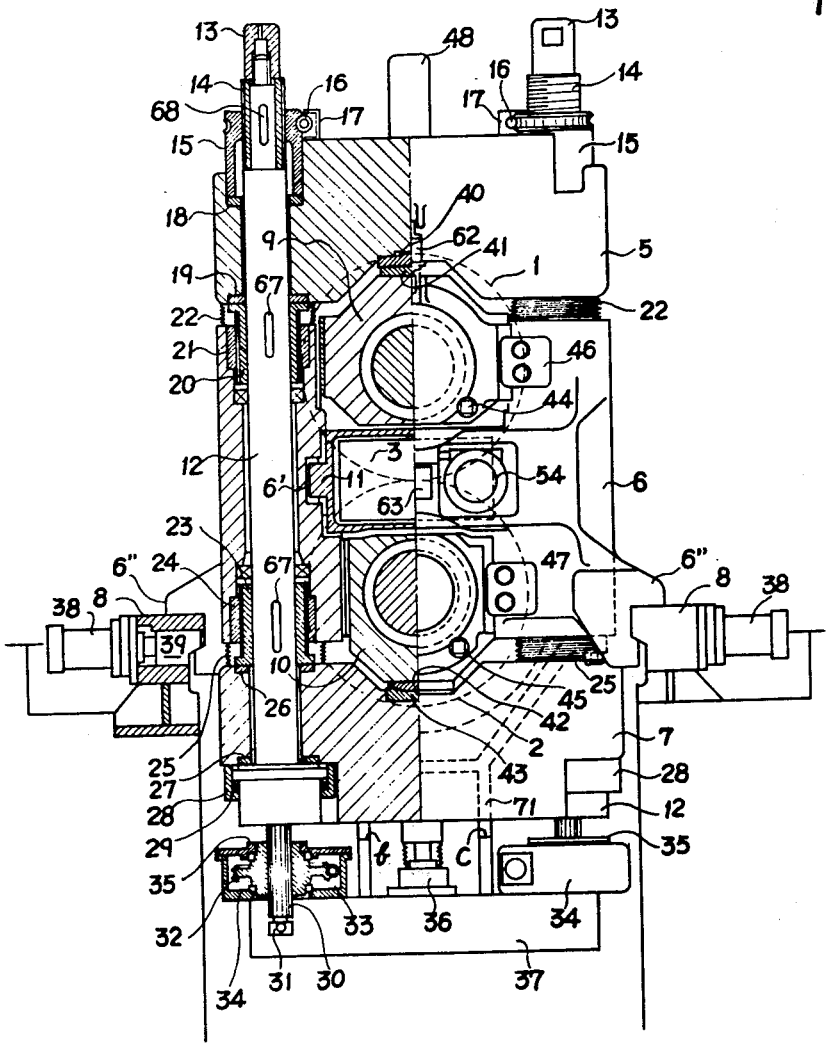
FIG. 1 is a side view of an embodiment of a prestressed universal rolling mill according to the present invention, with the left half thereof showing a sectional view taken through the center of the tension bar for explaining the function of the tension bars constituting a principal feature of the present invention.
Figure 3:
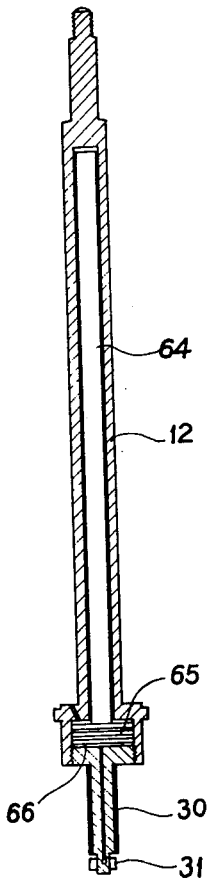
FIG. 3 is a longitudinal sectional view of the tension bar shown in FIG. 1.
Figure 2:
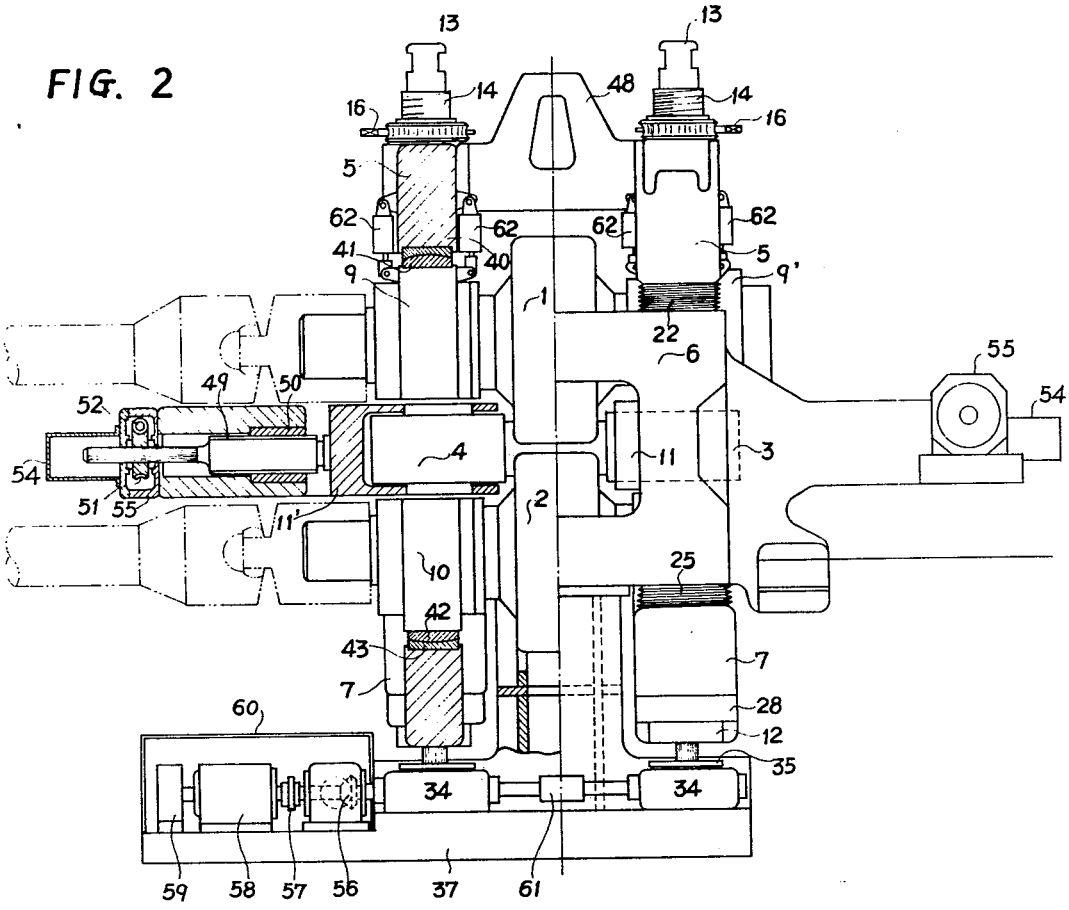
FIG. 2 is a front view of the rolling mill of FIG. 1 useful in explaining the manner in which the four prestressed tension bars are notated by means of one set of motor and reducer.

Referring to FIGS. 1 and 3, a prestressed universal rolling mill provided in accordance with the present invention comprises an intermediate frame 6 having feet 6″ securely fastened to a sole plate 8 by means of hydraulic cylinders 38, a lower cross beam 7 arranged below the intermediate frame 6 and normally forced upward by means of balancing cylinders 36 so that the lower cross beam 7 goes downward by virtue of its own weight into engagement with and stopped by stoppers b and c only upon releasing of the hydraulic pressure, and an upper cross beam 5 arranged above the intermediate frame 6, with the upper and lower cross beams 5 and 7 and the intermediate frame 6 being bound together by means of four tension bars 12. A bottom horizontal roll 2 is mounted on the lower cross beam 7 through the intermediary of lower roll chocks 10 and spherical seats 42 and 43, a top horizontal roll 1 is mounted on the upper cross beam 5 through the intermediary of upper roll chocks 9, spherical seats 41 and 40 and balancing cylinders 62 provided on the upper roll chocks 9, and left and right vertical rolls 3 and 4 are mounted on the intermediate frame 6 through the intermediary of vertical roll chocks 11 each having its projection 11′ fitted into the associated groove 6′ formed in the intermediate frame 6. Each of the tension bars 12 is connected at its lower end to a conventional swivel joint 31 which introduces a pressure oil, a portion of the tension bar 12 immediately above the lower end is formed into a hollow splined rod 30 whose upper end constitutes a hydraulic cylinder cover, and a tension bar portion above the splined rod 30 is formed into a hydraulic cylinder 66 whose lower end receives the pressure oil that is forced thereinto. A piston 65 is mounted inside the hydraulic cylinder 66, and a compression rod 64 connected to the upper surface of the piston 65 is inserted into an elongated hole formed inside the tension bar 12 and having a closed upper end so that the tension bar 12 is elongated when the end face of the compression rod 64 forces the top inner face of the elongated hole. The splined rod 30 of the tension bar 12 is fitted into the hub of a worm gearing 32 in the associated turning gear box 34 arranged on a frame 37, so that the four tension bars 12 may be rotated simultaneously by means of a motor 58, a bevel gear 56 at the end of worms 33 engaged with the worm gears 32. The tension bar 12 is also provided with an externally threaded thread ring 14 fitted on the upper portion thereof through the intermediary of a stud key 68, and a cap nut 13 is threadedly mounted on the top of the tension bar 12. A nut 15 having a worm gear cut in its outer surface and internal threads cut in its inner surface for engagement with the external threads of the thread ring 14 is mounted on the thread ring 14 with a liner 18 provided at the lower end of the nut 15, so that the nut 15 is caused to slide vertically in accordance with the rotation of a worm 16 engaged with the worm gear on the nut 15. An upper thread ring 20 is fitted on substantially the central portion of the tension bar 12 through the intermediary of a stud key 67, and the upper thread ring 20 has its upper surface abutted against a liner 19 and its threaded portion engaged with a nut 21 fitted in the intermediate frame 6 thus causing the upper thread ring 20 to slide vertically in accordance with the rotation of the tension bar 12. A lower thread ring 23 is similarly fitted on the lower portion of the tension bar 12 through the intermediary of a stud key 67 with its lower surface abutting against a liner 26 and its threaded portion engaged with a nut 24 fitted in the intermediary frame 6 thus causing the lower thread ring 23 to slide vertically in accordance with the rotation of the tension bar 12. The upper and lower thread rings 20 and 23 are oppositely threaded with the same pitch so that the upper and lower thread rings 20 and 23 are moved toward or away from each other in accordance with the rotation of the tension bar 12, thus adjusting the clearance of the upper and lower cross beams 5 and 7 and hence the clearance of the top and bottom horizontal rolls 1 and 2. The threaded portion of the thread ring 14 is threaded in the same direction as the lower thread ring 23 with the pitch being two times the pitch of the threaded portions of the upper and lower thread rings 20 and 23, and the tension bar 12 is also provided with a collar formed on the outer surface of the hydraulic cylinder 66 in such a manner that its lower and upper surfaces are normally abutted respectively against a thrust bearing 29 and a liner 27. Thus, each of the tension bars 12 is moved with respect to the upper cross beam 5 by an amount corresponding to the sum of the movements of the upper and lower cross beams 5 and 7 caused by the rotation of the tension bars, and the nut 15 is moved by the same amount as the movement of the tension bar 12 into engagement with the liner 18. When a hydraulic pressure is introduced into the hudraulic cylinder 66 of each tension bar 12, the tension bar 12 is elongated, and thus the cap nut 13, the thread ring 14 and the nut 15 are moved upward as a unit by the same amount as the tension bar elongation. After the lower surface of the nut 15 has been pressed closely against the liner 18 by the rotation of the worm 16, the rotation of the nut 15 is prevented, and then the hydraulic pressure is released thus accomplishing a prestressing. On the other hand, each of the roll chocks 11 respectively carrying the vertical rolls 3 and 4 is provided with a splined screwdown screw 49 having the end of its threaded portion abutted against the associated vertical roll, its threaded portion engaged with a nut 50 fitted in the intermediary frame 6 and its splined portion fitted into the hub of a worm wheel 51, so that the screwdown screw 49 is rotated in accordance with the rotation of a vertical roll screwdown motor 55 to advance or retreat its threaded portion for adjusting the position of the vertical roll.

A supporting frame 71 is attached to the lower surface of the intermediate frame 6 by means of bolts 72, and the lower portion of the supporting frame 71 is securely mounted on the frame 37 so as to always be held fixedly in position.

With the construction described above, the necessary prestressing force is always applied to the intermediate frame and the upper and lower cross beams, and the tension bars excepting only the compression bars and the intermediate frame contribute toward improving the mill rigidity. In this case, since the contribution of the intermediate frame is so great that the mill rigidity may be readily improved by increasing the thickness of the intermediate frame. To release the prestressing force, a pressure oil is supplied to the swivel joint connected to the lower end of each tension bar, so that the piston within the hydraulic cylinder is forced upward and hence the compression bar forces the top inner surface of the elongated hole upward to elongate the tension bar, and the position of the horizontal rolls can be adjusted in this released condition. To accomplish this, the motor connected through the worm gearing, etc. to the splined rod at the lower end of each tension bar is rotated to rotate the tension bar, and the upper and lower thread rings engaged with the upper and lower stud keys on each tension bar and threaded oppositely with each other are moved toward or away from each other. After the positions of the horizontal rolls have been adjusted, the hydraulic pressure in each of the tension bars is released to restore the prestressed condition.

In the event that jamming of a material being rolled is caused by any irregularity in the rolling operation, the jamming force can be eliminated by applying the above-mentioned hydraulic pressure to the tension bars to thereby quickly deal with the irregularity. In addition, the use of a breaker that tends to reduce the mill rigidity is eliminated.

It will thus be seen from the foregoing description that the present invention has a very great industrial value in that not only the settings of the horizontal rolls can be adjusted very easily, but also an improved mill rigidity is ensured, and moreover the roll changing can be accomplished in a short period of time.

What is claimed is:

1. A prestressed universal rolling mill of a type in which a roll stand for supporting a top horizontal roll, a bottom horizontal roll and vertical rolls is divided into three parts composed of an upper cross beam, a lower cross beam and an intermediate frame and tied together by a plurality of tension bars, characterized in that said tension bars are adapted so that said three parts of the roll stand are bound together by said tension bars with each thereof being elongated by the application of a hydraulic pressure and thereafter said hydraulic pressure is removed to apply a prestressing force to said roll stand, each of said tension bars is rotated within a hole provided in said housing to permit an easy adjustment of the clearance between said top and bottom horizontal rolls, said tension bars are simultaneously actuated from a single source of power, each of said tension bars includes a pair of nuts respectively mounted on the upper and lower portions of said tension bar extending through said hole in said intermediate frame, each of said nuts having threads formed on the inner surface thereof, a pair of thread rings each thereof having external threads adapted for engagement with one of said nuts and an internal surface adapted for loose fit on said tension bar, each of said thread rings adapted to be rotated by said tension bar by means of a stud key mounted thereon, a third externally threaded thread ring mounted on the upper end of said tension bar, a cylindrical nut having internal threads adapted for engagement with the external threads of said third thread ring and a worm wheel formed on the outer surface thereof, a worm adapted for engagement with said worm wheel, a thrust bearing fitted in said lower cross beam to restrain the longitudinal movement of said tension bar, said threads of said pair of thread rings are opposite in direction and of the same pitch as the other, and said threads of said third thread ring are in the same direction as the threads of said lower thread ring of said pair of thread rings and of a pitch two times the pitch of said threads of said pair of thread rings.

2. A prestressed universal rolling mill of a type in which a roll stand for supporting a top horizontal roll, a bottom horizontal roll and vertical rolls is divided into three parts composed of an upper cross beam, a lower cross beam and an intermediate frame and tied together by a plurality of tension bars, characterized in that said tension bars are adapted so that said three parts of the roll stand are bound together by said tension bars with each thereof being elongated by the application of a hydraulic pressure and thereafter said hydraulic pressure is removed to apply a prestressing force to said roll stand, that each of said tension bars is rotated within a hole provided in said housing to permit an easy adjustment of the clearance between said top and bottom horizontal rolls, and that said tension bars are simultaneously actuated from a single source of power, said mill further including means for supplying said hydraulic pressure to each said tension bar, said means including the body portion of said tension bar having a closed top, an elongated internal hole and a hydraulic cylinder provided at the lower end of said tension bar, the lower structure of said tension bar including an upper portion providing a cover for said hydraulic cylinder, a central portion in the form of a hollow splined rod for hydraulic pressure and a swivel joint connected to the lower portion thereof for introducing hydraulic pressure, a piston mounted in said hydraulic cylinder and adapted to be forced up by said hydraulic pressure, and a compressed bar movably mounted in said elongated hole of said tension bar with the lower end thereof in abutting engagement with said piston so that the upper end of said compression bar forces upward said closed top of said tension bar body portion when said piston is forced up by said hydraulic pressure.

3. A prestressed universal rolling mill of a type in which a roll stand for supporting a top horizontal roll, a bottom horizontal roll and vertical rolls is divided into three parts composed of an upper cross beam, a lower cross beam and an intermediate frame and tied together by a plurality of tension bars, said tension bars having disposed thereon an upper thread ring and a lower thread ring being located at the top and bottom surfaces respectively of said intermediate frame, said tension bars are adapted so that said three parts of the roll stand are bound together by said tension bars with each thereof being elongated by the application of a hydraulic pressure and thereafter said hydraulic pressure is removed to apply a prestressing force to said roll stand wherein the improvement comprises that each of said tension bars is rotated within a hole provided in said three parts to permit an easy adjustment of the distance between the upper surface of said upper thread ring and the lower surface of said lower thread ring, and that said tension bars are simultaneously rotated from a single source of power.

4. A prestressed universal rolling mill according to claim 3, further comprising a pair of nuts respectively mounted on the upper and lower portions of said tension bar that extends through said hole in said intermediate frame, each of said nuts having threads formed on the inner surface thereof, and secured in said hole in said intermediate frame at its outer surface, said thread rings each having external threads adapted to engage one of said nuts and an internal surface adapted for a slidable fit on said tension bar, each of said thread rings adapted to be rotated by said tension bar by means of a stud key mounted thereon, a third externally threaded thread ring mounted on the upper end of said tension bar, a cylindrical nut having internal threads adapted for engagement with the external threads of said third thread ring and a worm wheel formed on the outer surface thereof, a worm adapted for engagement with said worm wheel, and a thrust bearing fitted in said lower cross beam to restrain the longitudinal movement of said tension bar, whereby accomplishing said adjustment of the clearance between said top and bottom horizontal rolls.

5. A prestressed universal rolling mill according to claim 4, wherein said pair of thread rings on each of said tension bars includes means for moving said upper and lower rings toward or away from each other in accordance with the rotation of said tension bar, causing said upper and lower cross beams and hence said horizontal rolls carried on said cross beams to move vertically the same distance toward or away from each other.

* * * * *